United States Patent [19]

Kaneda et al.

[11] Patent Number: 4,975,473

[45] Date of Patent: Dec. 4, 1990

[54] COATING COMPOSITION AND CAST-COATED PAPER COATED WITH THE SAME

[75] Inventors: Katsumi Kaneda; Teruo Hyugaji; Akio Tanaka, all of Kanagawa; Nobuo Kuroda, Tottori; Itsuro Yamamoto; Noriaki Matsuda, both of Tottori, all of Japan

[73] Assignees: Mitsui Toatsu Chemicals, Inc.; Oji Paper Co., Ltd., both of Tokyo, Japan

[21] Appl. No.: 317,366

[22] Filed: Mar. 1, 1989

[30] Foreign Application Priority Data

| | | | |
|---|---|---|---|
| Mar. 2, 1988 | [JP] | Japan | 63-47496 |
| Mar. 2, 1988 | [JP] | Japan | 63-47497 |
| Mar. 2, 1988 | [JP] | Japan | 63-47498 |
| Mar. 2, 1988 | [JP] | Japan | 63-47499 |
| Mar. 2, 1988 | [JP] | Japan | 63-47500 |

[51] Int. Cl.[5] ..... C08L 09/08

[52] U.S. Cl. ..... 523/221

[58] Field of Search ..... 523/221, 335; 524/426, 524/433, 501

[56] References Cited

U.S. PATENT DOCUMENTS

| | | | |
|---|---|---|---|
| 4,567,099 | 1/1986 | Van Gilder et al. | 428/327 |
| 4,620,992 | 11/1986 | Nojima et al. | 427/362 |

FOREIGN PATENT DOCUMENTS

| | | | |
|---|---|---|---|
| 9179895 | 10/1984 | Japan | 524/501 |

*Primary Examiner*—Joseph L. Schoffer
*Assistant Examiner*—R. H. Delmendo
*Attorney, Agent, or Firm*—Millen, White & Zelano

[57] ABSTRACT

A coating composition for a cast-coated paper which principally comprises a pigment and an adhesive and in which the adhesive is composed of (A) a rubber latex having an average particle size of 0.1 to 0.3 micron and (B) a rubber latex or an acrylic emulsion having an average particle size of 0.5 to 1.5 micron and the sum of the solid content of the components (A) and (B) is in the range of 9 to 30 parts by weight per 100 parts by weight of the pigment is herein provided. The coating composition may further contain casein as a binder. In addition, inorganic compounds selected from NaCl, $Na_2SO_4$, ZnO and MgO and organic acid salts selected from formates or acetates of Ca, Zn, Mg may be added to the coating composition as coagulants. The use of the aforesaid coating composition makes it possible to produce cast-coated paper having excellent permeability, gloss and surface strength at a high speed.

5 Claims, No Drawings

COATING COMPOSITION AND CAST-COATED PAPER COATED WITH THE SAME

BACKGROUND OF THE INVENTION

The present invention relates to a composition capable of being applied to paper at high speeds in a cast-coating and to the resultant cast-coated paper.

Various methods are known for manufacturing cast-coated paper, such as wet cast coating, gel cast coating, and rewet cast coating techniques. The wet cast coating method comprises applying a water-based paint containing a pigment and an adhesive to a base paper and bringing the still wet paper into contact with a high temperature heated mirror drum ("cast drum") to dry coated paper. The gel cast coating method comprises either applying a water-based paint containing a coagulant to a base still wet paper and bringing the paper into contact with the cast drum to dry the same, or else applying a water-based paint to a base paper, applying a coagulant containing coating onto the painted paper, and then bringing the still wet paper into contact with a cast drum to dry the same. The rewet cast coating process comprises the steps of applying a waterbased paint to a base paper, drying the paper and again wetting the paper prior to bringing it into contact with the cast drum to dry it. High gloss art paper is supercalendered in a dry state, while the cast-coated paper s smoothed while it is still wet, state in i.e., while the coated layer is still in a highly plastic state, in either of these cast coating techniques. The cast coating technique produces a high gloss smooth coated surface.

It is of primary importance in the cast coating process that the coated paper is clearly released from the surface of the cast drum after the coated surface containing a great deal of water is brought into contact with the cast drum to dry the same. This process is used to obtain a coated paper having a high gloss which is free of defects. It has been known that good adhesion to the cast drum surface is an essential requirement for imparting high gloss to the cast-coated paper and leads to a substantial reduction in the releasability of the coating. Therefore, manufacture of high gloss, defect-free (e.g., pin holes in the coating) cast-coated paper requires advanced technology. However, as the speed of releasing the coated paper from the cast drum is increased resistance is encountered during the releasing operation. As a result, the coated film on the paper adheres to the surface of the cast drum and a partial pick-up of the paper is sometimes observed (such defects in the coated paper being referred to as "pit(s)"). Accordingly, it is very difficult to obtain a defect-free coated paper having a uniform gloss.

Moreover, in general the heated drum is required to quickly evaporate moisture from the coated paper; but, when the machine is operated at high speed, the length of time during which the coated paper contacts on the drum is reduced. Therefore, extreme drying conditions must be employed to increase the mobility of vapor. As a result, a novel problem arises. In the wet cast coating process the paint boils, thereby destroying the coated layer. In the gel cast coating process, it is difficult to transfer a large amount of water in the gelled coated layer to the base paper, which in turn hinders formation of a uniform surface. In the rewet cast coating process, once dried, the coated layer is rewetted to impart plasticity thereto; therefore, a relatively high pressure s applied to the coated paper on the drum as compared to the foregoing two cast coating techniques. As a result, the small water pools often form between the drum surface and the coated film, which are quite difficult to remove through voids from the coated film. This leads to the formation of pits differing from those formed due to pick-up and results in a cast-coated paper having numerous defects.

In order to solve these problems associated with the cast-coated paper and to enable high speed production while maintaining the quality of the coated paper surface, a method has been proposed in which a coagulant, such as a sulfate, nitrate, formate, or acetate of a metal such as zinc, aluminum, or magnesium, is incorporated into a paint principally composed of a pigment and an adhesive such as a latex containing a polymer having repeated units derived from an unsaturated carboxylic acid as a functional monomer or casein (see Japanese Patent Publication No. 60-146097). This patent states that metal ions of the coagulant affect the carboxyl groups of the copolymeric latex to cause coagulation during drying of the coated layer, producing a porous coated layer which is more easily permeated by evaporated moisture when the coated paper is rewetted and pressed against the heated cast drum according to the rewet cast coating technique. However, this method produces a cast-coated paper having a low surface strength and the production speed is still unsatisfactory.

SUMMARY OF THE INVENTION

Accordingly, an object of the present invention is to provide an improved coating composition for use with the conventional methods for manufacturing cast-coated paper, particularly the rewet cast coating method whose production speed is relatively high, and to provide a cast-coated paper having a high gloss and high surface strength which is free of defects (pits), such coating having a good releasability from the cast drum and hence, preventing the formation of pits even during an extremely high speed production.

Another object of the present invention is to provide a cast-coated paper having excellent releasability, gloss, surface strength and free of pits even when it is manufactured at a higher speed than has ever been achieved in the art.

According to one aspect of the present invention, there is provided a coating composition for cast-coated paper which comprises mainly a pigment and an adhesive, characterized in that the adhesive comprises, per 100 parts by weight of the pigment, (A) 6 to 18 parts by weight, expressed in solids content, of a latex having an average particle size of 0.1 to 0.3 microns and (B) 3 to 12 parts by weight, expressed in solids content, of a latex or an acrylic emulsion having an average particle size of 0.5 to 1.5 microns the sum of the solids content of the components (A) and (B) being in the range of 9 to 30 parts by weight.

According to another aspect of the present invention, there is provided a coating composition for cast-coated paper which comprises mainly a pigment and an adhesive, characterized in that the adhesive comprises per 100 parts by weight of the pigment, (A) 2 to 15 parts by weight of casein; (B) 6 to 18 parts by weight, expressed in solids content, of a rubber latex having an average particle size ranging from 0.1 to 0.3 microns; (C) 3 to 12 parts by weight, expressed in solids content, of an acrylic emulsion or a secondary particle-forming rubber latex having an average particle size ranging from 0.1 to 0.3 microns; and (D) at least one inorganic compound selected from the group consisting of NaCl, $Na_2SO_4$, ZnO and MgO and at least one organic acid salt selected from the group consisting of formates and acetates of calcium, zinc and magnesium, the total solid content of the components (A), (B) and (C) being in the range of 18 to 40 parts by weight.

According to another aspect of the present invention, there is provided a coating composition for making cast-coated paper which comprises mainly a pigment and an adhesive characterized in that the adhesive comprises a latex (A) having a gel content of not less than 50% and an acrylic emulsion (B) having a gel content of not less than 50%.

DETAILED DESCRIPTION OF THE INVENTION

In the present invention, the total amount (solid content per 100 parts by weight of the pigment used) of the binders (A) and (B) is limited to 9 to 30 parts by weight. This is because if the binders are used in a total amount of less than 9 parts by weight, the surface strength of the resulting cast-coated paper coated with such a paint is too low to be used in a practical printing operation, while if it is more than 30 parts by weight, the cast-coated paper coated with such a paint exhibits insufficient releasability which makes it difficult to achieve high speed production of cast-coated paper. The preferred total amount ranges from 10 to 25 parts by weight.

Moreover, in the present invention, the amount of the latex (A) employed per 100 parts by weight of the pigment is restricted to 6 to 18 parts by weight (solids content). The reason of this is that if it is used in an amount less than 6 parts by weight, the resultant cast-coated paper has low surface strength while if the amount thereof exceeds 18 parts by weight, the releasability of the coated paper from the cast drum is unsatisfactory, the coated paper has low permeability, and a lot of pits are formed on the coated surface. The preferred amount of the latex (A) ranges from 7 to 16 parts by weight.

In addition, the amount of the binder (B) is limited to 3 to 12 parts by weight per 100 parts by weight of the pigment (solids content) in the present invention. This is because if it is less than 3 parts by weight, the adhesion between the cast drum and the coated surface of the paper is impaired, the gloss thereof is lowered and a lot of pits are formed in the resultant coated surface of the paper, while if it is more than 12 parts by weight, the releasability of the coated paper becomes insufficient and thus, pits are formed in the coated surface of the paper. The preferred amount is in the range of 4 to 10 parts by weight.

In the present invention, the average particle size of the latex (A) is restricted to 0.1 to 0.3 microns. This is because when the particle size is less than 0.1 microns, the resultant paint has high viscosity, the releasability of the coated paper becomes insufficient and thus, it is difficult to obtain a smooth coated surface free of pits, even if the particle size of the binder (B) is limited to 0.5 to 1.5 microns. On the other hand, if the average particle size of the latex (A) exceeds 0.3 micron, the resulting cast-coated paper to which a paint containing such a latex is applied has a low surface strength and a lot of pits are formed. Therefore, it is difficult to achieve the intended high speed production of cast-coated paper.

Moreover, the average particle size of the binder (B) is restricted to 0.5 to 1.5 microns. The reason of this is that if the average particle size of the binder (B) is less than 0.5 microns, the resulting cast-coated paper shows low permeability, many pits are formed thereon and thus, it is difficult to achieve the intended high speed production, while if it is more than 1.5 microns, the resultant cast-coated paper has a low surface strength and, therefore, printing operations cannot be carried out practically. In this respect, it should be noted that the binders (A) and (B) fulfill the requirement for the average particle size of the binders (A) and (B) after the preparation of the paint composition and that the average particle size of the binder by itself does not necessarily fall within the above defined range before the preparation of the composition. For instance, a latex (A) is prepared so as to have a chemically stable particle size ranging from 0.1 to 0.3 microns and separately a latex or acrylic emulsion having a particle size ranging from 0.1 to 0.3 microns followed by flocculating it by the addition of a small amount of polyvalent metal ions such as calcium or aluminum ions to control the particle size thereof to 0.5 to 1.5 micron, and then stabilizing it by adding a surfactant or a protective colloid agent to prepare the component (B). When a paint which has been obtained using the binders thus prepared is examined with a transmission electron microscope, it is confirmed, from the difference between the contrasts of the particle images, that the binders (A) and (B) independently maintain their particle size at the time of preparation, respectively. In other words, the latex (A) forms denser images in which the particles exist in a distinct state, while the acrylic emulsion (B) forms less dense images in which the particles exist as aggregates composed of several particles. This method for controlling particle size is described by way of example and it may be controlled during preparation of the paint. The binder such as the aforementioned latex or acryl emulsion which is converted to the latex or acrylic emulsion (B) of the invention by adding a small amount of polyvalent metal cations or by aggregation operation during the process for preparing the paint will hereinafter be referred to as a precursor (B). It is also possible to use a binder (B) whose particle size is controlled so as to fall within the above defined range during synthesizing the same, but this is not economical.

The term "latex" used herein is the generic name of rubber type emulsions and, therefore, the components contained in the latex are polymers whose essential repeating units are those derived from diene monomers such as butadiene, isoprene and/or 2-chlorobutadiene. In addition, the term "acrylic emulsion" used herein is the generic name of polymer emulsions in which the polymer is principally composed of repeating units derived from the following monomers and does not contain diene type monomer units.

Examples of such monomers which may be used as copolymerizable monomer units other than the diene type in the latex and which may be used as principal monomer units of the polymer in the acrylic emulsion are aromatic alkenyl compounds such as styrene, alphamethyl styrene, chlorostyrene and dimethyl styrene; and mono-olefinic unsaturated compounds such as methyl acrylate, ethyl acrylate, butyl acrylate, 2-ethylhexyl acrylate, glycidyl acrylate, methyl methacrylate, ethyl methacylate, butyl methacrylate, 2-ethylhexyl methacrylate, hydroxyethyl methacrylate, hydroxypropyl methacrylate, glycidyl methacrylate, acrylamide, N-methylol-acrylamide, N-methoxymethylacrylamide, methacrylamide, N-methylolmethacrylamide, N-methoxymethacrylamide, acrylic acid, methacrylic acid, crotonic acid, alkyl fumalates, alkyl itaconates, acrylonitrile, methacrylonitrile, and vinyl acetate. These monomers may be used alone or in combination.

The binders used in the invention may be prepared by polymerizing or copolymerizing the foregoing monomers in the presence of a commonly used polymerization initiator such as water-soluble peroxides e.g., potassium persulfate, sodium persulfate and ammonium persulfate which may be used in combination with a water-soluble reducing agent such as sodium bisulfite, sodium sulfite and sodium thiosulfate. The polymerization reaction is generally carried out at a temperature of 50 to 100° C and a gauge pressure of 0 to 10 kg/cm$^2$. All the monomers used in the polymerization may be added in one lot, in portions or continuously. In addition, it is also possible to add, during polymerization, an emulsifying agent such as sodium alkylbenzenesulfonates, sodium alkylsulfates and sodium alkylalcohol sulfates or a protective colloid agent such as a hydroxyethyl cellulose, carboxymethyl cellulose and polyvinyl alcohol. In this respect, the particle size of the resulting particles becomes small as the amount of the emulsifying agent with respect to the total amount of the monomers is increased and vice versa. Moreover, the molecular weight of the resultant particles may be controlled by the addition of a molecular weight controlling agent a mercaptan such as an alkylmercaptan and a tertiary mercaptan, carbon tetrachloride and a higher alcohol. Thus, the binder compositions having a particle size of 0.1 to 0.3 microns and 0.5 to 1.5 microns, respectively, used in the present invention can be easily prepared according to the foregoing conditions and methods.

The latex and acrylic emulsion as used herein preferably contain at least a certain level of toluene insolubles (generally referred to as "gel content") of the dried film thereof which relates to the molecular weight and the degree of cross-linking of the polymer included in the latex and acryl emulsion. In order to ensure the intended high speed production, the gel content thereof is preferably not less than 15% by weight.

The pigments used in the present invention are not restricted to specific ones and examples thereof include such inorganic pigments as clay, calcium carbonate, titanium white, satin white, aluminum hydoxide, barium sulfate, zinc oxides and magnesium oxides; and organic pigments such as plastic pigments and white urea resin pigments.

The adhesive used herein may further comprise, in addition to the foregoing binders (A) and (B), water-soluble polymers such as casein and modified starch in an amount of 2 to 15 parts by weight per 100 parts by weight of the pigments present in the paint of this invention.

The paint composition of the present invention may contain, according to need, such known coagulants as calcium formate, magnesium formate or zinc acetate; and/or such known release agents as magnesium stearate or zinc stearate. The paint composition of the invention may contain anionic surfactants, nonionic surfactants or the like in addition to the previously added stabilizers for stably maintaining the aggregated particles of the binder (B) in a state.

Casein used as the component (A) in another aspect of the invention is preferably milk casein commonly used as a binder for pigment-coated paper. If the amount thereof is less than 2 parts by weight per 100 parts by weight of the pigment, the releasability of the cast-coated paper to which such a paint is applied becomes insufficient and thus the intended high speed production can be attained only with substantial difficulty. While if it exceeds 15 parts by weight, the permeability of the coated layer is highly impaired and hence, a lot of pits are formed in the resultant cast-coated paper. The preferred amount of casein (A) ranges from 4 to 12 parts by weight.

Moreover, the rubber type latex as a component (B) of the adhesive is used in an amount of 6 to 18 parts by weight per 100 parts by weight of the pigment. This is because if it is less than 6 parts by weight, the resultant cast-coated paper shows low surface strength and cannot stand practical printing operations, whereas, if it is more than 18 parts by weight, the releasability of the coated paper becomes quite low, a lot of pits are formed and, therefore, the intended high speed production is hard to achieve. The preferred amount of the rubber type latex (B) ranges from 7 to 16 parts by weight.

In addition, the acrylic emulsion or secondary particle-forming latex used as a component of the adhesive is used in an amount of 3 to 12 parts by weight per 100 parts by weight of the pigment. The reason for this is that if the amount of the component (C) is less than 3 parts by weight, the adhesion of the cast-coated paper to the drum surface is insufficient, the gloss is reduced and a lot of pits are formed, while if the amount exceeds 12 parts by weight, the resulting cast-coated paper shows a low ink receptivity affecting the printability thereof and thus, a good printing surface cannot be obtained. The preferred amount of the component (C) ranges from 4 to 10 parts by weight.

The sum of the amount of these components (A) to (C) ranges from 18 to 40 parts by weight per 100 parts by weight of the pigment This is because if it is less than 18 parts by weight, the resulting cast-coated paper has too low surface strength to stand practical printing operations, while if it exceeds 40 parts by weight, properties of releasing the cast-coated paper from the drum surface become insufficient and hence, high speed production becomes very difficult. The preferred ranges are from 20 to 35 parts by weight.

The term "rubber latex as a component (B)" used herein is the generic name of the rubber emulsions of copolymers having, as essential components (repeating units), those derived from butadiene and styrene or methyl methacrylate; and, as optional components, those derived from such non-ionic hydrophilic monomers as hydroxyethyl methacrylate, hydroxypropyl methacrylate, acrylamide, N-methylolacrylamide, N-methoxymethylacrylamide, methacrylamide, N-methylolmethacrylamide and N-methoxymethylmethacrylamide; and such anionic monomers as acrylic acid, itaconic acid and methacrylic acid, the total amount of these optional components being not less than 2% by weight, preferably not less than 2% by weight and less than 10% by weight. Diene type monomers such as isoprene and/or 2-chlorobutadiene may also be used instead of or in addition to butadiene. Examples of comonomer components used other than diene type monomers and styrene or methyl methacrylate are such aromatic alkenyl compounds as alpha-methylstyrene, chlorostyrene and such mono-olefin type unsaturated compounds as methyl acrylate, ethyl acrylate, butyl acrylate, 2-ethylhexyl acrylate, glycidyl acrylate, ethyl methacrylate, butyl methacrylate, 2-ethylhexyl methacrylate, glycidyl methacrylate, alkyl fumalates, alkyl itaconates, acrylonitrile, methacrylonitrile and vinyl acetate. These monomers may be used alone or in combination.

The term "acrylic emulsion(s)" used herein means those containing (co)polymers composed of repeating units derived from the monomer components listed above in connection with the rubber latex (B) except for diene type monomers, such as aromatic alkenyl compounds, acrylates, acrylamides, unsaturated carboxylic acids and their esters, nitriles and vinyl acetate. These monomers and copolymerizable monomers may be used alone or in combination.

The secondary particle-forming latex used as a component (C) is latex of a polymer composed of repeating units derived from the monomers listed above in connection with the rubber latex (B) provided that the sum of the non-ionic hydrophilic monomers and the anionic monomers is less than 2% by weight, preferably not less than 0.5% by weight, and less than 2% by weight. The particle size of the secondary particles can be freely controlled by properly adjusting the total amount of these non-ionic hydrophilic monomers and the anionic monomers within the above defined range.

The particle size of the components (B) and (C) is generally in the range of 0.1 to 0.3 microns. In addition, these synthetic binders, preferably, comprise more than a certain level of toluene-insolubles (commonly referred to as "gel content") of a dried film which relates to the molecular weight and the degree of crosslinking of the polymer. The gel content is preferably not less than 15% by weight in order to ensure the intended high speed production.

The adhesive may, further, include, as the component (D), both at least one inorganic substance selected from the group consisting of NaCl, $Na_2SO_4$, ZnO and Mg0; and at least one organic acid salt selected from the group consisting of calcium, zinc and magnesium salts of formic acid or acetic acid. These additives are added to the paint composition in a small amount during preparation of the composition mainly composed of pigments, casein (A), the rubber latex (B) and the acrylic emulsion or secondary particle-forming latex (C) and selectively cause flocculation. The use of such a combination of at least one inorganic substance selected from the group consisting of NaCl, $Na_2SO_4$, ZnO and MgO; and at least one organic acid salt selected from the group consisting of calcium, zinc and magnesium salts of formic acid or acetic acid makes it possible to obtain a cast-coated paper having good permeability free of pits even when it is formed according to high speed production technique, and cast-coated surfaces which exhibit good gloss, high surface strength and excellent ink receptivity. Preferably, the inorganic and organic additives are composed of a combination of three components, i.e., one inorganic substances selected from the group consisting of NaCl and $Na_2SO_4$, one oxide selected from the group consisting of ZnO and MgO and one organic acid salt selected from the group consisting of calcium, zinc and magnesium salts of formic acid or acetic acid.

The amount of these inorganic substances and the organic salts used is desirably determined so that the component (C) used as the synthetic binder having a particle size of 0.1 to 0.3 microns is selectively aggregated to from secondary particles and to increase the particle size of the resulting aggregates to 0.5 to 1.5 microns. In general, the amount ranges from 0.1 to 7 parts by weight of the inorganic substances and from 0.1 to 3 parts by weight of the organic salts, per 100 parts by weight of the pigment.

The manufacture of components (B) and (C) can be carried out according to the aforementioned polymerization processes and conditions and the particle sizes of the resultant latex and the acrylic emulsion are adjusted to the ranges defined above according to the foregoing methods.

In addition, a protective colloid agent, such as polyvinyl alcohol and hydroxyethyl cellulose, anionic surfactants, non-ionic surfactant or the like may be added to, the paint composition as a stabilizer to stabilize the aggregated component (C) therein.

According to another aspect of the present invention, the adhesive contains both a latex (A) having a gel content of not less than 50% and an acrylic emulsion (B) having a gel content of not less than 50% to ensure the high-speed production of cast-coated paper. In this connection, if the gel content of the latex (A) is less than 50%, the releasability of the coated paper from &he drum surface is insufficient, and it is difficult to obtain a smooth coated-surface having no pits even if the gel content of the acryl emulsion (B) is not less than 50%. Moreover, if the gel content of the acryl emulsion is less than 50%, the permeability of the cast-coated paper coated with such a paint composition is reduced, and numerous pits are formed; thus, high-speed production is difficult, even if the gel content of the latex (A) is not less than 50%. The latex (A) and the acrylic emulsion (B) are used in an amount of 5 to 19 parts by weight and 3 to 13 parts by weight per 100 parts by weight of the pigment, respectively.

The gel content of the latex can be adjusted through the use of a mercaptan such as an alkyl mercaptan or a tertiary mercaptan, or such a chain transfer agent as carbon tetrachloride and a higher alcohol. It is effective to use these compounds not only individually but in combination of two or more. These compounds are used in an amount of not more than 5.0% by weight on the basis of the total amount of the monomers. The gel content of the acrylic emulsions may be controlled according to a method of using such an auxiliary monomer component as a monomer having carboxyl group(s), a monomer having hydroxyl group(s), a monomer having methylol group (s) or a monomer having glycidyl group(s) to cause intraor inter-molecular crosslinking reactions to thus adjust the gel content thereof; or a method in which a monomer having divinyl group(s) is used as an auxiliary monomer component. Either of these methods is effective to control the gel content and these methods may be employed in combination.

In this respect, examples of the monomers having carboxyl group(s) are acrylic acid, methacrylic acid, itaconic acid maleic acid, aconitic acid and citraconic acid; examples of monomers having hydroxyl group(s) are hydroxyethyl (meth)acrylate and hydroxypropyl (meth)acrylate; examples of monomers having methylol group(s) include methylol (meth)acrylamide and methoxymethyl (meth)acrylamide; and examples of monomers having glycidyl group(s) include glycidyl (meth)acrylate. At least two of these monomers having functional group(s) are preferably used in combination, and in general, these monomers having functional group(s) are used in an amount of 1.0 to 10% by weight on the basis of the total amount of the monomers. In addition, examples of monomers having divinyl group(s) include allyl (meth)acrylate, ethylene di(meth)acrylate, phenylene diacrylonitrile and divinylbenzene which may be used alone or in combination. The foregoing examples of the monomers having functional group(s) and the monomers having divinyl group(s) are simply identified by way of example and, therefore, monomers having reactive functional group(s) and those having polymerizable vinyl group(s) may likewise be used.

The cast-coated paper according to the present invention can be manufactured by applying a paint composition thus prepared to the surface of a base paper utilizing a known coating apparatus commonly used for manufacturing pigment-coated paper, such as an air knife coater, a roll coater or a blade coater. Once the coated base paper is dried, it is then rewetted with water and pressed against a cast drum heated to a temperature of not less than 60° C. at a linear pressure of not less than 10 kg/cm to dry the coated paper. According to the invention, the base paper is not restricted to a specific type and any paper can usually be used for making pigment-coated paper.

The cast-coated paper thus prepared shows high surface strength and excellent gloss, a uniform surface free of pits, as well as good ink receptivity, permeability and releasability. Thus, such a cast-coated paper can be produced according to a high speed production technique. The paint composition of the invention is useful as a paint for manufacturing the cast-coated paper according to not only the rewet cast coating technique but also the wet cast coating and gel cast coating techniques.

The present invention will be explained hereinafter in greater detail with reference to the following Examples and Comparative Examples, but the invention is not to be restricted to these Examples given below. In the following Examples and Comparative Examples, the terms "part(s)" and "%" are "part(s) by weight" and "% by weight" unless otherwise specified.

EXAMPLE 1

In this example, methods for preparing a latex (A) herein used and a latex (B) used herein are first illustrated and then a method for preparing a paint composition according to the present invention is described.

(Preparation of Latex (A-1))

Deionized water (120 parts), sodium dodecylbenzenesulfonate (0.2 parts), potassium persulfate (0.8 parts), t-dodecyl mercaptan (0.6 parts), and monomer components, i.e., 40 part of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were changed into an autoclave purged with nitrogen gas, followed by polymerizing the monomers at 70° C, stopping the polymerization after 15 hours when the degree of polymerization exceeded 98%, cooling the reaction mixture, and adjusting pH to 7 with sodium hydroxide to obtain a latex (A-1). The particle size of the resultant latex was 0.15 micron.

(Preparation of Precursor of Latex (B))

Deionized water (120 parts), sodium dodecylbenzenesulfonate (0.1 parts), potassium persulfate (0.8 parts), t-dodecyl mercaptan (0.6 parts), and monomer components, i.e., 40 parts of butadiene, 50 parts of styrene, 7 parts of methyl methacrylate and 3 parts of methacrylic acid (100 parts of monomers in all) were charged into an autoclave purged with nitrogen gas, followed by polymerizing the monomers at 70° C, stopping the polymerization after 16 hours when the degree of polymerization exceeded 97%, cooling the reaction mixture, adjusting pH to 7 with aqueous ammonia solution to obtain the precursor of a latex (B). The particle size of the precursor of the latex (B) was 0.18 microns.

(Preparation of Coating Composition)

53.3 Parts of an aqueous casein solution (corresponding to 8 parts expressed in the amount of solid) prepared by heating a mixture of 28% aqueous ammonia (0.8 parts), 8 parts of milk casein and 44.5 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components, adding 3.5 parts (corresponding to 0.7 parts expressed in the amount of solid content) of 20% aqueous solution of calcium acetate and then adding 12 parts (solid content) of the latex (A-1) and 7 parts (solid content) of the precursor of the latex (B) previously prepared. Finally, the solids content of the paint was controlled to 40% to obtain a paint composition-1 for cast-coated paper according to the present invention. The viscosity of the paint was 35 cps which was determined at 25° C. and 60 r.p.m. using Brookfield Viscometer. In addition, the particle size of the latex in the paint was examined by a transmission electron microscope and found to be 0.15 m for the latex (A-1) and 0.85 to 0.95 m for the latex (B). The proportion of each ingredient of the paint composition-1, physical properties thereof and the like are listed in Table I given below.

EXAMPLES 2 TO 7

Coating compositions 2 to 7 were prepared according to the same procedures and conditions as in Example 1 except that the amount of casein used; the amount of the latex (A-1) and the precursor of the latex (B) added and the total amount of these; as well as the amount of calcium acetate added were changed to those listed in Table I. The solids contents of these paint compositions, Brookfield viscosity, the particle size of the latexes (A-1) and (B) in the paint were likewise determined or observed in the same manner as in Example 1 and the results thus obtained were also listed in Table I.

EXAMPLE 8

In this Example, a method for preparing a latex (A-2) used herein and the preparation of a paint are illustrated.

(Preparation of Latex (A-2))

Deionized water (120 parts), sodium dodecylbenzenesulfonate (0.3 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 14 hours when the degree of polymerization exceeded 98%, cooling the reaction mixture, adjusting pH to 7 with sodium hydroxide to obtain a latex (A-2). The particle size of the resultant latex was 0.1 micron.

(Preparation of Coating Composition)

53.3 Parts of an aqueous casein solution (corresponding to 8 parts expressed in the amount of solids) prepared by heating a mixture of 28% aqueous ammonia (0.8 parts), 8 parts of milk casein, and 44.5 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components, adding 1.5 parts (corresponding to 0.3 parts expressed in the amount of solids content) of 20% aqueous solution of calcium acetate and then adding 12 parts (solids content) of the latex (A-2) and 7 parts (solids content) of the precursor of the latex (B) previously prepared. Finally, the solids content of the paint was controlled at 40% to obtain a paint composition-8 for cast-coated paper according to the present invention. The viscosity of the paint was 120 cps which was determined at 25° C. and 60 r.p.m. using Brookfield Viscometer. In addition, the particle size of the resultant latex in the paint was examined by a transmission electron microscope and found to be 0.1 microns for the latex (A-2) and 0.5 to 0.7 microns for the latex (B). The proportion of each ingredient of the paint composition-8, physical properties thereof and the like are listed in Table I given below.

EXAMPLE 9

A coating composition-9 was prepared according to the same procedures and conditions as in Example 8 except that the amount of calcium acetate in Example 1 was changed to that shown in Table I. The solid content of the paint composition, Brookfield viscosity, the particle size of the resultant latexes (A-2) and (B) in the paint or the like were likewise determined or observed in the same manner as in Example 8 and the results thus obtained were also listed in Table I.

EXAMPLE 10

In this Example, a method for preparing a latex (A-3) used herein and the preparation of a paint are illustrated.

(Preparation of Latex (A-3))

Deionized water (120 parts), sodium dodecylbenzenesulfonate (0.15 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 16 hours when the degree of polymerization exceeded 98%, cooling the reaction mixture, adjusting pH to 7 with sodium hydroxide to obtain a latex (A-3). The size of the resultant latex particles was 0.3 microns.

(Preparation of Coating Composition)

53.3 Parts of an aqueous casein solution (corresponding to 8 parts expressed in the amount of solid) prepared by heating a mixture of 28% aqueous ammonia (0.8 parts), 8 parts of milk casein, and 44.5 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components, adding 1.5 parts (corresponding to 0.3 parts expressed in the amount of solids content) of 20% aqueous solution of calcium acetate and then adding 12 parts (solids content) of the latex (A-3) and 7 parts (solids content) of the precursor of the latex (B) previously prepared. Finally, the solids content of the paint was controlled to 40% to obtain a paint composition-10 for cast-coated paper according to the present invention. The viscosity of the paint was 40 cps which was determined at 25° C. and 60 r.p.m. using Brookfield Viscometer. In addition, the size of the latex particles in the paint was examined by a transmission electron microscope and found to be 0.3 microns for the latex (A-3) and 0.5 to 0.7 microns for the latex (B). The proportion of each ingredient of the paint composition-10, physical properties thereof and the like are listed in Table I given below.

EXAMPLE 11

A coating composition-11 was prepared according to the same procedures and conditions as in Example 10 except that the amount of calcium acetate in Example 10 was changed to that shown in Table: I. The solids content of the paint composition, Brookfield viscosity, the particle size of the resultant latexes (A-3) and (B) in the paint or the like were likewise determined or observed in the same manner as in Example 10 and the results thus obtained were also listed in Table I.

COMPARATIVE EXAMPLES 1 TO 6

Comparative compositions-1 to -6 were prepared according to the same procedures and conditions as in Example 1 except that the amount of casein and calcium acetate used were changed as well as the amount of the latexes (A-1) and (B) and the total amount thereof were outside the range of the present invention, as listed in Table I. The solids content of these paints, Brookfield viscosity, and the particle size of the latexes (A-1) and (B) in the paint are also listed in Table I.

COMPARATIVE EXAMPLES 7 AND 8

In this Comparative Example, the latexes (A-1) and (B) are independently used in paint compositions to make the effectiveness of the simultaneous use thereof more clear. In other words, Comparative compositions-7 and 8 were prepared according to the same procedures and conditions as in Example 1 except that the amount of calcium acetate was changed and the latexes were separately used in amount equal to the total amount of these two latexes in Example 1 (see Table I). The solids content of these paints, Brookfield viscosity, and the size of particles of the latexes in the paints are also listed in Table I.

COMPARATIVE EXAMPLE 9

In this Comparative Example, a method for preparing a latex (A-4) used herein and the preparation of a paint are illustrated.

(Preparation of Latex (A-4))

Deionized water (120 parts), sodium dodecylbenzenesulfonate (0.4 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 13 hours when the degree of polymerization exceeded 99%, cooling the reaction mixture, adjusting pH to 7 with sodium hydroxide to obtain a latex (A-4). The particle size of the resultant latex was 0.08 microns.

(Preparation of Coating Composition)

53.3 Parts of an aqueous casein solution (corresponding to 8 parts expressed in the amount of solids) prepared by heating a mixture of 28% aqueous ammonia (0.8 parts), 8 parts of milk casein and 44.5 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components, and then adding 12 parts (solid content) of the latex (A-4) and 7 parts (solids content) of the precursor of the latex (B) previously prepared. Finally, the solids content of the paint was controlled to 40% to obtain a comparative paint composition-9 for cast-coated paper. The viscosity of the paint was 825 cps which was determined at 25° C. and 60 r.p.m. using Brookfield Viscometer. In addition, the size of the latex particles in the paint was examined by a transmission electron microscope and found to be 0.08 microns for the latex (A-4) and 0.18 microns for the latex (B). The proportion of each ingredient of the comparative paint composition-9, physical properties thereof and the like are listed in Table I given below.

COMPARATIVE EXAMPLE 10

In this Comparative Example, a method for preparing the latex (A-5) used herein and the preparation of a paint are illustrated.

(Preparation of Latex (A-5))

Deionized water (120 parts), sodium dodecylbenzenesulfonate (0.1 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 18 hours when the degree of polymerization exceeded 97%, cooling the reaction mixture, adjusting pH to 7 with sodium hydroxide to obtain a latex (A-5). The size of the resultant latex particles was 0.35 microns.

(Preparation of Coating Composition)

53.3 Parts of an aqueous casein solution (corresponding to 8 parts expressed in the amount of solid) prepared by heating a mixture of 28% aqueous ammonia (0.8 parts), 8 parts of milk casein and 44.5 parts of water to dissolve these ingredients and 100 parts of water were charged into a Cauress mixer, followed by adding 40 parts of calcium carbonate (TP-222HS; available from OKUTAMA KOGYO C!0., LTD.) and 60 parts of kaolin (UW-90; available from EMC) with stirring to admix and disperse the components, adding 7 parts (corresponding to 1.4 parts expressed in solid content) of 20% aqueous solution of calcium acetate and then adding 12 parts (solid content) of the latex (A-5) and 7 parts (solid content) of the precursor of the latex (B) previously prepared. Finally, the solid content of the paint was controlled to 40% to obtain a comparative paint composition-10 for cast-coated paper. The viscosity of the paint was 26 cps which was determined at 25° C. and 60 r.p.m. using Brookfield Viscometer. In addition, the size of the latex particles in the paint was examined by a transmission electron microscope and found to be 0.35 microns for the latex (A-5) and 1.08 to 2.16 microns for the latex (B). The proportion of each ingredient of the comparative paint composition-10, physical properties thereof and the like are listed in Table I given below.

TEST EXAMPLE

Each of the coating compositions obtained in the foregoing Examples and Comparative Examples was applied to the surface of base paper having a basic weight of 64.0 g/m$^2$ with an air-knife coater in an amount of 25 g/m$^2$ (weighed after drying), dried, treated with a rewetting solution, and then passed through a cast drum. The casting was carried out utilizing a drum having a diameter of 1200 mm, at a linear pressure of 50 kg/cm and a surface temperature of 95 to 100° C to obtain maximum casting speed at which good releasability is maintained and no pits are formed on the paper surface. In addition, the permeability of the coated paper prior to casting was determined and the gloss and surface strength of the resultant cast-coated paper were estimated. The results thus obtained are listed in Table II below. In this respect, the permeability was determined with a permeability tester (developed by OKEN and the gloss was determined in accordance with JIS P-8142. The surface strength was determined by RI Printing Tester (available from MEI MANUFACTURING CO., LTD.) and visually observing the surface to estimate it according to a 10-stage evaluation. 10th stage stands for the best surface having no picking 1st stage the worst surface having picking throughout the surface and thus the estimation was performed according to 10 stages of evaluation from 1st stage to 10th stage.

TABLE I

| Ingredients of | Example | | | | | | | | | | |
|---|---|---|---|---|---|---|---|---|---|---|---|
| Coating Composition | 1 | 2 | 3 | 4 | 5 | 6 | 7 | 8 | 9 | 10 | 11 |
| Kaolin | 60 | 60 | 60 | 60 | 60 | 60 | 60 | 60 | 60 | 60 | 60 |
| Calcium carbonate | 40 | 40 | 40 | 40 | 40 | 40 | 40 | 40 | 40 | 40 | 40 |
| Casein | 8 | 11 | 5 | 12 | 4 | 13 | 5 | 8 | 8 | 8 | 8 |
| Calcium acetate | 0.7 | 0.4 | 1.0 | 0.7 | 0.8 | 0.4 | 1.0 | 0.3 | 1.0 | 0.3 | 1.0 |
| Latex (A) | A-1 | A-1 | A-1 | A-1 | A-1 | A-1 | A-1 | A-2 | A-2 | A-3 | A-3 |
| | 12 | 12 | 12 | 7 | 16 | 6 | 15 | 12 | 12 | 12 | 12 |
| Latex (B) | 7 | 4 | 10 | 7 | 8 | 4 | 10 | 7 | 7 | 7 | 7 |

TABLE I-continued

| | | | | | | | | | | | |
|---|---|---|---|---|---|---|---|---|---|---|---|
| (A) + (B) | 19 | 16 | 22 | 14 | 24 | 10 | 25 | 19 | 19 | 19 | 19 |
| Physical Properties of Coating Composition | | | | | | | | | | | |
| Solid content (%) | 40 | 40 | 40 | 40 | 40 | 40 | 40 | 40 | 40 | 40 | 40 |
| Viscosity (cps) | 35 | 70 | 30 | 85 | 30 | 105 | 25 | 120 | 100 | 40 | 30 |
| Particle size of latex in the coating composition (μm) | | | | | | | | | | | |
| (A) | 0.15 | 0.15 | 0.15 | 0.15 | 0.15 | 0.15 | 0.15 | 0.1 | 0.1 | 0.3 | 0.3 |
| (B) | 0.85 ~ 0.95 | 0.85 ~ 0.95 | 0.85 ~ 0.95 | 0.85 ~ 0.95 | 0.85 ~ 0.95 | 0.85 ~ 0.95 | 0.85 ~ 0.95 | 0.5 ~ 0.7 | 1.1 ~ 1.5 | 0.5 ~ 0.7 | 1.1 ~ 1.5 |

| Ingredients of Coating Composition | Comparative Example 1 | 2 | 3 | 4 | 5 | 6 | 7 | 8 | 9 | 10 |
|---|---|---|---|---|---|---|---|---|---|---|
| Kaolin | 60 | 60 | 60 | 60 | 60 | 60 | 60 | 60 | 60 | 60 |
| Calcium carbonate | 40 | 40 | 40 | 40 | 40 | 40 | 40 | 40 | 40 | 40 |
| Casein | 14 | 1 | 9 | 10 | 4 | 14 | 8 | 8 | 8 | 8 |
| Calcium acetate | 0.1 | 0.7 | 1.3 | 0.7 | 1.4 | 0.2 | — | 1.9 | — | 1.4 |
| Latex (A) | A-1 | A-1 | A-1 | A-1 | A-1 | A-1 | A-1 | | A-4 | A-5 |
| | 12 | 19 | 12 | 4 | 19 | 4 | 19 | — | 12 | 2 |
| Latex (B) | 1 | 7 | 13 | 7 | 14 | 2 | — | 9 | 7 | 7 |
| (A) + (B) | 13 | 26 | 25 | 11 | 33 | 6 | 9 | 19 | 19 | 19 |
| Physical Properties of Coating Composition | | | | | | | | | | |
| Solid content (%) | 40 | 40 | 40 | 40 | 40 | 40 | 40 | 40 | 40 | 40 |
| Viscosity (cps) | 235 | 23 | 40 | 65 | 35 | 580 | 85 | 30 | 825 | 26 |
| Particle size of latex in the coating composition (μm) | | | | | | | | | | |
| (A) | 0.15 | 0.15 | 0.15 | 0.15 | 0.15 | 0.15 | 0.15 | — | 0.08 | 0.35 |
| (B) | 0.85 ~ 0.95 | 0.85 ~ 0.95 | 0.85 ~ 0.95 | 0.85 ~ 0.95 | 0.85 ~ 0.95 | 0.85 ~ 0.95 | — | 0.85 ~ 0.95 | 0.18 | 1.08 ~ 2.16 |

TABLE II

| Coating Composition | Casting Speed (m/min.) | Permeability Prior to Casting | Cast-coated Paper Surface Strength | Cast-coated Paper Gloss |
|---|---|---|---|---|
| Example 1 | 65 | 1600 | 10 | 90 |
| Example 2 | 60 | 1850 | 10 | 89 |
| Example 3 | 65 | 1400 | 9 | 90 |
| Example 4 | 65 | 1500 | 10 | 89 |
| Example 5 | 60 | 1720 | 10 | 91 |
| Example 6 | 65 | 1330 | 9.5 | 88 |
| Example 7 | 65 | 1480 | 10 | 91 |
| Example 8 | 60 | 1950 | 10 | 91 |
| Example 9 | 60 | 1700 | 9.5 | 90 |
| Example 10 | 65 | 1280 | 9.5 | 89 |
| Example 11 | 65 | 1150 | 9 | 88 |
| Comp. Ex. 1 | 45 | 2350 | 10 | 85 |
| Comp. Ex. 2 | 35 | 2300 | 9 | 92 |
| Comp. Ex. 3 | 30 | 3900 | 10 | 90 |
| Comp. Ex. 4 | 45 | 1000 | 5 | 80 |
| Comp. Ex. 5 | 25 | 7400 | 10 | 89 |
| Comp. Ex. 6 | 45 | 1200 | 6 | 85 |
| Comp. Ex. 7 | 30 | 5500 | 10 | 82 |
| Comp. Ex. 8 | 45 | 1500 | 5 | 92 |
| Comp. Ex. 9 | 25 | 7800 | 10 | 88 |
| Comp. Ex. 10 | 30 | 1200 | 3 | 80 |

EXAMPLE 12

(Preparation of Latex A-6))

Deionized water (120 parts), sodium dodecylbenzenesulfonate (0.2 parts), potassium persulfate (0.8 parts), t-dodecyl mercaptan (0.6 parts), and monomer components, i.e., 40 parts of butadiere, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 15 hours when the degree of polymerization exceeded 98%, cooling the reaction mixture, and adjusting pH to 7 with sodium hydroxide to obtain a latex (A-6). The size of the resultant latex particles was 0.15 microns.

(Preparation of Precursor of Acrylic Emulsion (B))

Deionized water (120 parts), sodium dodecylbenzenesulfonate (0.1 parts), ammonium persulfate (0.8 parts), and monomer components, i.e., 40 part of butyl acrylate, 50 parts of styrene, 7 parts of methyl methacrylate and 3 parts of methacrylic acid (100 parts of monomers in all) were charged into a three-necked glass reactor purged with nitrogen gas, followed by polymerizing the monomers at 70° C, stopping the polymerization after 8 hours when the degree of polymerization exceeded 97%, cooling the reaction mixture, adjusting pH to 7 with an aqueous ammonia solution to obtain a precursor of acryl emulsion (B). The particle size of the resultant precursor was 0.18 microns.

(Preparation of Coating Composition)

53.3 Parts of an aqueous casein solution (corresponding to 8 parts expressed in the amount of solid) prepared by heating a mixture of 28% aqueous ammonia (0.8 parts), 8 parts of milk casein and 44.5 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components, adding 3.5 parts (corresponding to 0.7 parts expressed in solids content) of 20% aqueous solution of calcium acetate and then adding 12 parts (solid content) of the latex (A-6) and 7 parts (solids content) of the precursor of the latex (B) prepared above. Finally, the solid content of the paint was controlled to 40% to obtain a paint composition-12 for cast-coated paper according to the present invention. The viscosity of the paint was 30 cps which was determined at 25° C and 60 r.p.m. using Brookfield Viscometer. In addition, the size of the synthetic binders in the paint was examined by a transmission electron microscope and found to be 0.15 microns for the latex (A-6) and 0.85 to 1.0 microns for the acryl emulsion (B). The proportion of each ingredient of the paint composition 12, physical properties thereof and the like are listed in Table III below.

EXAMPLES 13 TO 18

Paint compositions 13 to 18 were prepared according to the same procedures and conditions as in Example 12 except that the amount of casein used; the amount of the latex (A-6) and the precursor of the latex (B) added and the total amount of these; as well as the amount of calcium acetate added were changed to those listed in Table III. The solids contents of these paint compositions, Brookfield viscosity, the particle size of the latex (A-6) and the acryl emulsion (B) in the paint or the like were likewise determined or observed in the same manner as in Example 12 and the results thus obtained were also listed in Table III.

EXAMPLE 19

(Preparation of Latex (A-7))

Deionized water (120 parts), sodium dodecylbenzenesulfonate (0.3 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 14 hours when the degree of polymerization exceeded 98%, cooling the reaction mixture, adjusting pH to 7 with sodium hydroxide to obtain a latex (A-7). The size of the resultant latex particles was 0.1 micron.

(Preparation of Coating Composition)

53.3 Parts of an aqueous casein solution (corresponding to 8 parts expressed in the amount of solid) prepared by heating a mixture of 28% aqueous ammonia (0.8 parts), 8 parts of milk casein and 44.5 parts of water to dissolve these ingredients and 100 parts of water were charged into a Cauress mixer, followed by adding 40 parts of calcium carbonate (TP-222HS; available from OKUTAMA KOGYO CO., LTD.) and 60 parts of kaolin (UW-90; available from EMC) with stirring to admix and disperse the components, adding 1.5 parts (corresponding to 0.3 parts expressed in the amount of solid content) of 20% aqueous solution of calcium acetate and then adding 12 parts (solid content) of the latex (A-7) and 7 parts (solid content) of the precursor of the acryl emulsion (B) previously prepared. Finally, the solids content of the paint was controlled to 40% to obtain a paint composition-19 for cast-coated paper according to the present invention. The viscosity of the paint was 115 cps which was determined at 25° C and 60 r.p.m. using Brookfield Viscometer. In addition, the size of the latex particles in the paint was examined by a transmission electron microscope and found to be 0.1 microns for the latex (A-7) and 0.5 to 0.7 microns for the acryl emulsion (B). The proportion of each ingredient of the paint composition-19, physical properties thereof and the like are listed in Table III below.

EXAMPLE 20

A paint composition-20 was prepared according to the same procedures and conditions as in Example 19 except that the amount of calcium acetate in Example 19 was changed to that shown in Table III. The solid content of the paint composition, Brookfield viscosity, the particle size of the latex (A-7) and the acryl emulsion (B) in the paint or the like were likewise determined or observed in the same manner as in Example 19 and the results thus obtained were also listed in Table III.

EXAMPLE 21

(Preparation of Latex (A-8))

Deionized water (120 parts), sodium dodecylbenzenesulfonate (0.15 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 16 hours when the degree of polymerization exceeded 98%, cooling the reaction mixture, adjusting pH to 7 with sodium hydroxide to obtain a latex (A-8). The size of the latex particles was 0.3 micron.

(Preparation of Coating Composition)

53.3 Parts of an aqueous casein solution (corresponding to 8 parts expressed in the amount of solid) prepared by heating a mixture of 28% aqueous ammonia (0.8 parts), 8 parts of milk casein and 44.5 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components, adding 1.5 parts (corresponding to 0.3 parts expressed in the amount of solids content) of 20% aqueous solution of calcium acetate and then adding 12 parts (solids content) of the latex (A-8) and 7 parts (solids content) of the precursor of the acryl emulsion (B) previously prepared. Finally, the solids content of the paint was controlled to 40% to obtain a paint composition-21 for cast-coated paper according to the present invention. The viscosity of the paint was 35 cps which was determined at 25° C. and 60 r.p.m. using Brookfield Viscometer. In addition, the size of the latex particles in the paint was examined by a transmission electron microscope and found to be 0.3 microns for the latex (A-8) and 0.5 to 0.7 microns for the acryl emulsion (B). The proportion of each ingredient of the paint composition-21, physical properties thereof and the like are listed in Table III below.

EXAMPLE 22

A paint composition-22 was prepared according to the same procedures and conditions as in Example 21 except that the amount of calcium acetate in Example 21 was changed to that shown in Table III. The solids content of the paint composition, Brookfield viscosity, the particle size of the latex (A-8) and the acryl emulsion (B) in the paint or the like were likewise determined or observed in the same manner as in Example 21 and the results thus obtained were also listed in Table III.

COMPARATIVE EXAMPLES 11 TO 16

Comparative compositions 11 to 16 were prepared according to the same procedures and conditions as in Example 12 except that the amount of casein used and the amount of calcium acetate used were changed as well as the amount of the latex (A-6) and the precursor of the acryl emulsion (B) and the total amount of these were outside the range of the present invention. The solids content of these paints, Brookfield viscosity, and the particle size of the latex (A-6) and the acryl emulsion (B) in the paints are also listed in Table III.

COMPARATIVE EXAMPLES 17 AND 18

In this Comparative Example, the latex (A-6) and the acryl emulsion (B) are independently used in paint compositions to make the effectiveness of the simultaneous use thereof more clear. In other words, Comparative compositions 17 and 18 were prepared according to the same procedures and conditions as in Example 12 except that the amount of calcium acetate was changed and the latex and the acryl emulsion were separately used in an amount equal to the total amount of these two binders in Example 12 (see Table III). The solids content of these paints, Brookfield viscosity, and the particle size of the latex and the acryl emulsion in the paints are also listed in Table III.

COMPARATIVE EXAMPLE 19

(Preparation of Latex (A-9))

Deionized water (120 parts), sodium dodecylbenzenesulfonate (0.4 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all were charged into an autoclave purged with nitrogen gas, followed by polymerizing the monomers at 70° C, stopping the polymerization after 13 hours when the degree of polymerization exceeded 99%, cooling the reaction mixture, adjusting pH to 7 with sodium hydroxide to obtain a latex (A-9). The size of the resultant latex was 0.08 microns.

(Preparation of Coating Composition)

53.3 Parts of an aqueous casein solution (corresponding to 8 parts expressed in the amount of solids) prepared by heating a mixture of 28% aqueous ammonia (0.8 parts), 8 parts of milk casein and 44.5 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components and then adding 12 parts of the latex (A-9) and 7 parts (solids content) of the precursor of the acryl emulsion (B) previously prepared. Finally, the solids content of the paint was controlled to 40% to obtain a comparative paint composition-19 for cast-coated paper. The viscosity of the paint was 460 cps which was determined at 25° C. and 60 r.p.m. using Brookfield Viscometer. In addition, the size of the latex particles in the paint was examined by a transmission electron microscope and found to be 0.08 microns for the latex (A-9) and 0.18 microns for the acryl emulsion (B). The proportion of each ingredient of the comparative paint composition-19, physical properties thereof and the like are listed in Table III below.

COMPARATIVE EXAMPLE 20

(Preparation of Latex (A-10))

Deionized water (120 parts), sodium dodecylbenzenesulfonate (0.1 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 18 hours when the degree of polymerization exceeded 97%, cooling the reaction mixture, adjusting pH to 7 with sodium hydroxide to obtain a latex (A-10). The size of the resultant latex particles was 0.35 microns.

(Preparation of Coating Composition)

53.3 Parts of an aqueous casein solution (corresponding to 8 parts expressed in the amount of solids) prepared by heating a mixture of 28% aqueous ammonia (0.8 parts), 8 parts of milk casein and 44.5 parts of water to dissolve these ingredients and 100 parts of water were charged into a Cauress mixer, followed by adding 40 parts of calcium carbonate (TP-222HS; available from OKUTAMA KOGYO CO., LTD.) and 60 parts of kaolin (UW-90; available from EMC) with stirring to admix and disperse the components, adding 7 parts (corresponding to 1.4 parts expressed in solids content) of 20% aqueous solution of calcium acetate and then adding 12 parts (solid content) of the latex (A-10) and 7 parts (solid content) of the precursor of the acryl emulsion (B) previously prepared. Finally, the solids content of the paint was controlled to 40% to obtain a comparative paint composition-20 for cast-coated paper. The viscosity of the paint was 25 cps which was determined at 25° C and 60 r.p.m. using Brookfield Viscometer. In addition, the size of the latex particles in the paint was examined by a transmission electron microscope and found to be 0.35 microns for the latex (A-10) and 1.08 to 2.16 microns for the acryl emulsion (B). The proportion of each ingredient of the comparative paint composition 20, physical properties thereof and the like are listed in Table III below.

TEST EXAMPLE

According to the same manner as in the foregoing Test Example, a cast-coated paper was prepared using the paint compositions prepared in the foregoing Examples and Comparative Examples and the casting speed, permeability, glossiness and surface strength were determined. The results thus obtained are summarized in the following Table IV.

As seen from the data listed in Tables II and IV, according to the paint compositions of the invention in which each component fulfills the corresponding requirements, there are provided cast-coated papers having well-balanced qualities such as gloss, surface strength and permeability regardless of the paper being prepared by high speed production. This clearly indicates that the paint compositions according to the present invention quite unlike the conventional ones, are very useful for preparing cast-coated paper.

EXAMPLE 23

(Preparation of Rubber type Latex (B))

Deionized water (120 parts), sodium dodecylbenzenesulfonate (0.2 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C., stopping the polymerization after 15 hours when the degree of polymerization exceeded 98%, cooling the reaction mixture, and adjusting pH to 7 with sodium hydroxide to obtain a rubber type latex (B). The particle size of the resultant latex was found to be 0.15 micron.

TABLE IV

| Coating Composition | Casting Speed (m/min.) | Permeability Prior to Casting | Cast-coated Paper Surface Strength | Cast-coated Paper Gloss |
|---|---|---|---|---|
| Example 12 | 65 | 1350 | 10 | 91 |
| Example 13 | 65 | 1500 | 10 | 91 |
| Example 14 | 70 | 1150 | 9 | 92 |
| Example 15 | 70 | 1200 | 9.5 | 90 |
| Example 16 | 65 | 1400 | 10 | 91 |
| Example 17 | 70 | 1100 | 9 | 90 |
| Example 18 | 65 | 1210 | 10 | 91 |
| Example 19 | 65 | 1850 | 10 | 92 |
| Example 20 | 65 | 1600 | 9.5 | 91 |
| Example 21 | 70 | 1250 | 9.5 | 91 |
| Example 22 | 70 | 1000 | 9 | 90 |
| Comp. Ex. 11 | 45 | 2100 | 10 | 79 |
| Comp. Ex. 12 | 35 | 2000 | 7 | 92 |
| Comp. Ex. 13 | 40 | 3450 | 10 | 90 |
| Comp. Ex. 14 | 45 | 900 | 6 | 81 |
| Comp. Ex. 15 | 35 | 4550 | 10 | 88 |
| Comp. Ex. 16 | 45 | 1150 | 5 | 73 |
| Comp. Ex. 17 | 45 | 1000 | 4 | 92 |
| Comp. Ex. 18 | 35 | 5000 | 10 | 84 |
| Comp. Ex. 19 | 30 | 6500 | 10 | 87 |
| Comp. Ex. 20 | 35 | 950 | 3 | 72 |

TABLE III

| Ingredients of Coating Composition | Example 12 | 13 | 14 | 15 | 16 | 17 | 18 | 19 | 20 | 21 | 22 |
|---|---|---|---|---|---|---|---|---|---|---|---|
| Kaolin | 60 | 60 | 60 | 60 | 60 | 60 | 60 | 60 | 60 | 60 | 60 |
| Calcium carbonate | 40 | 40 | 40 | 40 | 40 | 40 | 40 | 40 | 40 | 40 | 40 |
| Casein | 8 | 11 | 5 | 12 | 4 | 13 | 5 | 8 | 8 | 8 | 8 |
| Calcium acetate | 0.7 | 0.4 | 1.0 | 0.7 | 0.8 | 0.4 | 1.0 | 0.3 | 1.0 | 0.3 | 1.0 |
| Latex (A) | A-6 | A-6 | A-6 | A-6 | A-6 | A-6 | A-6 | A-7 | A-7 | A-8 | A-8 |
| | 12 | 12 | 12 | 7 | 16 | 6 | 15 | 12 | 12 | 12 | 12 |
| Acrylic emulsion (B) | 7 | 4 | 10 | 7 | 8 | 4 | 10 | 7 | 7 | 7 | 7 |
| (A) + (B) | 19 | 16 | 22 | 14 | 24 | 10 | 25 | 19 | 19 | 19 | 19 |
| Physical Properties of Coating Composition | | | | | | | | | | | |
| Solid content (%) | 40 | 40 | 40 | 40 | 40 | 40 | 40 | 40 | 40 | 40 | 40 |
| Viscosity (cps) | 30 | 55 | 28 | 80 | 25 | 95 | 30 | 115 | 100 | 35 | 20 |
| Particle size of Synthetic Binder in Coating Composition (μm) | | | | | | | | | | | |
| (A) | 0.15 | 0.15 | 0.15 | 0.15 | 0.15 | 0.15 | 0.15 | 0.1 | 0.1 | 0.3 | 0.3 |
| (B) | 0.85 | 0.85 | 0.85 | 0.85 | 0.85 | 0.85 | 0.85 | 0.5 | 1.1 | 0.5 | 1.1 |
| | ~ | ~ | ~ | ~ | ~ | ~ | ~ | ~ | ~ | ~ | ~ |
| | 1.0 | 1.0 | 1.0 | 1.0 | 1.0 | 1.0 | 1.0 | 0.7 | 1.5 | 0.7 | 1.5 |

| Ingredients of Coating Composition | Comparative Example 11 | 12 | 13 | 14 | 15 | 16 | 17 | 18 | 19 | 20 |
|---|---|---|---|---|---|---|---|---|---|---|
| Kaolin | 60 | 60 | 60 | 60 | 60 | 60 | 60 | 60 | 60 | 60 |
| Calcium carbonate | 40 | 40 | 40 | 40 | 40 | 40 | 40 | 40 | 40 | 40 |
| Casein | 14 | 1 | 9 | 10 | 4 | 15 | 8 | 8 | 8 | 8 |
| Calcium acetate | 0.7 | 0.7 | 1.3 | 0.1 | 1.2 | 0.2 | 1.9 | — | — | 1.4 |
| Latex (A) | A-6 | A-6 | A-6 | A-6 | A-6 | A-6 | | A-6 | A-9 | A-10 |
| | 12 | 19 | 12 | 4 | 19 | 4 | — | 19 | 12 | 12 |
| Acrylic emulsion (B) | 1 | 7 | 13 | 7 | 14 | 2 | 19 | — | 7 | 7 |
| (A) + (B) | 13 | 26 | 25 | 11 | 33 | 6 | 19 | 19 | 19 | 19 |
| Physical Properties of Coating Composition | | | | | | | | | | |
| Solid content (%) | 40 | 40 | 40 | 40 | 40 | 40 | 40 | 40 | 40 | 40 |
| Viscosity (cps) | 210 | 20 | 37 | 55 | 30 | 190 | 35 | 95 | 460 | 25 |
| Particle size of Synthetic Binder in Coating Composition (μm) | | | | | | | | | | |
| (A) | 0.15 | 0.15 | 0.15 | 0.15 | 0.15 | 0.15 | — | 0.15 | 0.08 | 0.35 |
| (B) | 0.85 | 0.85 | 0.85 | 0.85 | 0.85 | 0.85 | | — | 0.18 | 1.08 |
| | ~ | ~ | — | — | — | — | — | | | ~ |
| | 1.0 | 1.0 | 1.0 | 1.0 | 1.0 | 1.0 | 1.0 | — | | 2.16 |

(Preparation of Acrylic Emulsion (C))

Deionized water (120 parts), sodium dodecylbenzenesulfonate (0.1 parts), ammonium persulfate (0.8 parts), and monomer components, i.e., 40 parts of butyl acrylate, 50 parts of styrene, 7 parts of methyl methacrylate and 3 parts of methacrylic acid (100 parts of monomers in all) were charged into a three-necked glass reactor purged with nitrogen gas, followed by polymerizing the monomers at 70° C, stopping the polymerization after 8 hours when the degree of polymerization exceeded 97%, cooling the reaction mixture, and adjusting pH to 7 with an aqueous ammonia solution to obtain an acryl emulsion (C). The particle size of the resultant acryl emulsion was 0.18 microns.

(Preparation of Coating Composition)

60 Parts of an aqueous casein solution (corresponding to 9 parts expressed in the amount of solid) prepared by heating a mixture of 28% aqueous ammonia (0.9 parts), 9 parts of milk casein and 50.1 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components and then adding 12 parts (solids content) of the rubber type latex (B) and 7 parts (solids content) of the acryl emulsion (C) previously prepared. Then, 0.3 parts of sodium chloride, 3 parts of zinc oxide and 0.7 parts of calcium acetate (solids content each) were added to the mixture, finally pH thereof was adjusted to 7 with ammonia and the solids content of the paint was controlled to 40% to obtain a paint composition 23 for cast-coated paper according to the present invention. The viscosity of the paint was 38 cps which was determined at 25° C and 60 r.p.m. using Brookfield Viscometer. The proportion of each ingredient of the paint composition-23, physical properties thereof and the like are listed in Table V below.

EXAMPLES 24 TO 32

Paint compositions 24 to 32 were prepared according to the same procedures and conditions as in Example 23 except for changing the amount of casein used, the amount of the rubber type latex (B) and the acryl emulsion (C), the total amount of these binders and the amount of sodium chloride, zinc oxide and calcium acetate to those listed in Table V. The solids contents and Brookfield viscosities of these paint compositions were determined in the same manner as in Example 23 and the results obtained were summarized in Table V.

COMPARATIVE EXAMPLES 21 TO 29

Paint compositions 21 to 28 were prepared according to the same procedures and conditions as in Example 23 except for changing the amount of chloride, zinc oxide and calcium acetate, the amount of casein used and the amount of the rubber type latex (B) and the acryl emulsion (C), and the total amount of these two binders to those listed in Table V. A paint composition 29 was prepared according to the same procedures and conditions as in Example 23 except that inorganic additives were not used but calcium acetate was used. The solids contents and Brookfield viscosities of these paint compositions are also summarized in Table V.

COMPARATIVE EXAMPLES 30 AND 31

In these Comparative Examples, there are illustrated experiments in which the rubber type latex (B) and the acryl emulsion (C) are separately employed in the paint compositions in order to make the effectiveness of the simultaneous use of these two synthetic binders clearer. In other words, Comparative compositions 30 and 31 were prepared according to the same procedures and conditions as in Example 23 except that the amount of calcium acetate was changed and the rubber type latex (B) and acryl emulsion (C) were separately used in an amount equal to the total amount of these two binders in Example 23. The solids content of these paints and Brookfield viscosity thereof are also listed in Table V.

TEST EXAMPLE

Each of the paint compositions obtained in the foregoing Examples and Comparative Examples was applied to the surface of base paper having a basis weight of 64.0 g/m$^2$ with an air-knife coater in an amount of 25 g/m$^2$ (weighed after drying), dried, treated with a rewetting solution and then passed through a casting drum. The casting was carried out utilizing a drum having a diameter of 1200 mm, at a linear pressure of 50 kg/cm and a surface temperature of 95 to 100° C to obtain maximum casting speed at which good releasability are maintained and no pits are formed on the paper surface. In addition, the permeability of the coated paper prior to casting was determined and the gloss and surface strength of the resultant cast-coated paper were estimated. The results thus obtained are listed in Table VI below. In this respect, the premeability was determined with a permeability Tester (developed by OKEN) and the gloss was determined in accordance with JIS P-8142. The ink receptibity was determined by RI Printing Tester (available from MEI MANUFACTURING CO.) and measuring ink receptive density on the printed surface with Macbeth type ink densitometer (available from TOKYO DENSHOKU CO., LTD.). The results obtained are listed in Table VI.

EXAMPLE 33

(Preparation of Rubber type Latex (B))

Deionized water (120 parts), sodium dodecylbenzenesulfonate (0.2 parts), potassium persulfate (0.8 parts), t-dodecyl mercaptan (0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 15 hours when the degree of polymerization exceeded 98%, cooling the reaction mixture, adjusting pH to 7 with sodium hydroxide to obtain a rubber type latex (B). The particle size of the latex was found to be 0.15 microns.

TABLE V

| Ingredients of | Example | | | | | | | | | | Comparative Example | | | |
|---|---|---|---|---|---|---|---|---|---|---|---|---|---|---|
| Coating Composition | 23 | 24 | 25 | 26 | 27 | 28 | 29 | 30 | 31 | 32 | 21 | 22 | 23 | 24 |
| Kaolin | 60 | 60 | 60 | 60 | 60 | 60 | 60 | 60 | 60 | 60 | 60 | 60 | 60 | 60 |

TABLE V-continued

| | | | | | | | | | | | | | | |
|---|---|---|---|---|---|---|---|---|---|---|---|---|---|---|
| Calcium carbonate | 40 | 40 | 40 | 40 | 40 | 40 | 40 | 40 | 40 | 40 | 40 | 40 | 40 | 40 |
| Casein (A) | 9 | 9 | 9 | 9 | 9 | 4 | 12 | 5 | 10 | 9 | 9 | 9 | 9 | 9 |
| Latex (B) | 12 | 12 | 12 | 16 | 7 | 12 | 12 | 10 | 10 | 12 | 12 | 12 | 19 | 5 |
| Acrylic emulsion (C) | 7 | 4 | 10 | 7 | 7 | 7 | 7 | 5 | 10 | 7 | 2 | 14 | 7 | 7 |
| Total amount of Binders | 28 | 25 | 31 | 32 | 23 | 23 | 31 | 20 | 35 | 28 | 23 | 35 | 35 | 21 |
| Sodium chloride | 0.3 | 0.3 | 0.3 | 0.3 | 0.3 | 0.1 | 0.4 | 0.2 | 0.3 | — | 0.3 | 0.3 | 0.3 | 0.3 |
| Zinc oxide | 3 | 3 | 3 | 3 | 3 | 1.3 | 4 | 1.7 | 3.3 | 3 | 3 | 3 | 3 | 3 |
| Calcium acetate | 0.7 | 0.4 | 1.0 | 0.7 | 0.7 | 0.7 | 0.7 | 0.5 | 1.0 | 0.7 | 0.2 | 1.4 | 0.7 | 0.7 |
| Solid content of Coating Composition (%) | 40 | 40 | 40 | 40 | 40 | 40 | 40 | 40 | 40 | 40 | 40 | 40 | 40 | 40 |
| Viscosity of Coating Composition (cps) | 38 | 45 | 30 | 40 | 55 | 25 | 85 | 28 | 60 | 30 | 45 | 25 | 48 | 60 |

| Ingredients of Coating Composition | Comparative Example 25 | 26 | 27 | 28 | 29 | 30 | 31 |
|---|---|---|---|---|---|---|---|
| Kaolin | 60 | 60 | 60 | 60 | 60 | 60 | 60 |
| Calcium carbonate | 40 | 40 | 40 | 40 | 40 | 40 | 40 |
| Casein (A) | 1 | 17 | 4 | 14 | 9 | 9 | 9 |
| Latex (B) | 12 | 12 | 8 | 17 | 12 | 19 | — |
| Acrylic emulsion (C) | 7 | 7 | 4 | 11 | 7 | — | 19 |
| Total amount of Binders | 20 | 36 | 16 | 42 | 28 | 28 | 28 |
| Sodium chloride | 0.1 | 0.6 | 0.1 | 0.5 | — | 0.3 | 0.3 |
| Zinc Oxide | 0.3 | 5.7 | 1.3 | 4.7 | — | 3 | 3 |
| Calcium acetate | 0.7 | 0.7 | 0.4 | 1.1 | 0.7 | — | 0.7 |
| Solid content of Coating Composition (%) | 40 | 40 | 40 | 40 | 40 | 40 | 40 |
| Viscosity of Coating Composition (cps) | 18 | 1840 | 23 | 360 | 20 | 275 | 25 |

TABLE VI

| Coating Composition | Casting Speed (m/min.) | Permeability Prior to Casting | Cast-coated Paper Surface Strength | Cast-coated Paper Gloss | Ink Receptivity |
|---|---|---|---|---|---|
| Example 23 | 75 | 450 | 10 | 92 | 1.75 |
| Example 24 | 75 | 430 | 10 | 92 | 1.76 |
| Example 25 | 75 | 480 | 10 | 93 | 1.73 |
| Example 26 | 75 | 680 | 10 | 93 | 1.76 |
| Example 27 | 75 | 400 | 9 | 92 | 1.75 |
| Example 28 | 75 | 380 | 9 | 93 | 1.74 |
| Example 29 | 75 | 600 | 10 | 91 | 1.76 |
| Example 30 | 75 | 350 | 9 | 89 | 1.75 |
| Example 31 | 70 | 730 | 10 | 92 | 1.73 |
| Example 32 | 70 | 500 | 10 | 91 | 1.76 |
| Comp. Ex. 21 | 55 | 440 | 9.5 | 76 | 1.77 |
| Comp. Ex. 22 | 50 | 860 | 10 | 92 | 1.62 |
| Comp. Ex. 23 | 45 | 1100 | 10 | 91 | 1.76 |
| Comp. Ex. 24 | 45 | 350 | 7 | 89 | 1.75 |
| Comp. Ex. 25 | 45 | 300 | 3 | 87 | 1.78 |
| Comp. Ex. 26 | 40 | 2150 | 10 | 91 | 1.73 |
| Comp. Ex. 27 | 55 | 320 | 5 | 86 | 1.76 |
| Comp. Ex. 28 | 45 | 3100 | 10 | 91 | 1.64 |
| Comp. Ex. 29 | 40 | 3400 | 10 | 90 | 1.74 |
| Comp. Ex. 30 | 35 | 5150 | 10 | 80 | 1.79 |
| Comp. Ex. 31 | 50 | 250 | 6 | 93 | 1.60 |

(Preparation of Secondary Particle-Forming Latex (C))

Deionized water (120 parts), ammonium persulfate dodecylbenzenesulfonate (0.1 parts), ammonium persulfate (0.8 parts), t-dodecyl mercaptan (0.4 parts), and monomer components, i.e., 25 part of butadiene, 64 parts of styrene, 7 parts of methyl methacrylate, 3 parts of methacrylic acid and 1 part of methylolmethacrylamide (100 parts of monomers in all) were charged into an autoclave purged with nitrogen gas, followed by polymerizing the monomers at 70° C, stopping the polymerization after 13 hours when the degree of polymerization exceeded 98%, cooling the reaction mixture, adjusting pH to 7 with an aqueous ammonia solution to obtain a secondary particle-forming latex (C). The particle size of the resultant latex was 0.19 microns.

(Preparation of Coating Composition)

60 Parts of an aqueous casein solution (corresponding to 9 parts expressed in the amount of solids) prepared by heating a mixture of 28% aqueous ammonia (0.9 parts), 9 parts of milk casein and 50.1 parts of water to dissolve these ingredients and 100 parts of water were charged into a Cauress mixer, followed by the addition of 40 parts of calcium carbonate (TP-222HS; available from OKUTAMA KOGYO CO., LTD.) and 60 parts of kaolin (UW-90; available from EMC) with stirring to admix and disperse the components and then adding 12 parts (solids content) of the rubber type latex (B) and 7 parts (solids content) of the secondary particle-forming latex (C) previously prepared. Then, 0.3 parts of sodium chloride, 3 parts of zinc oxide and 0.7 parts of calcium acetate (solids content each) were added to the mixture, finally pH thereof was adjusted to 8.0 with ammonia and the solids content of the paint was controlled to 40% to obtain a paint composition-33 for cast-coated paper according to the present invention. The viscosity of the paint was 45 cps which was determined at 25° C and 60 r.p.m. using Brookfield Viscometer. The proportion of each ingredient of the paint composition-33, physical properties thereof and the like are listed in Table VII below.

EXAMPLES 34 TO 42

Coating compositions 34 to 42 were prepared according to the same procedures and conditions as in Example 33 except for changing the amount of casein used, the amount of the rubber type latex (B) and the secondary particle-forming latex (C), the total amount of these binders and the amount of sodium chloride, zinc oxide and calcium acetate to those listed in Table VII. The solids content and Brookfield viscosities of these paint compositions were determined in the same manner as in Example 33, and the results obtained were summarized in Table VII.

COMPARATIVE EXAMPLES 32 TO 40

Comparative paint compositions 32 to 39 were prepared according to the same procedures and conditions as in Example 33 except that the amounts of sodium chloride, zinc oxide and calcium acetate were changed as listed in Table VII and the amount of casein and rubber type latex (B) and secondary particle-forming latex (C) as well as the total amount of these binders used were outside the range of this invention as shown in Table VII. A comparative paint composition 40 was prepared according to the same procedures and conditions as in Example 33 except that inorganic additives were not used but calcium acetate was used instead. The solids contents and Brookfield viscosities of these comparative paint compositions are also summarized in Table VII.

COMPARATIVE EXAMPLES 41 AND 42

In these Comparative Examples, there are illustrated experiments in which the rubber type latex (B) and the secondary particle-forming latex (C) are separately employed in the paint compositions in order to make the effectiveness of the simultaneous use of these two synthetic binders clearer. In other words, comparative compositions 41 and 42 were prepared according to the same procedures and conditions as in Example 33 except the amount of calcium acetate was changed as shown in Table VII and the latexes (B) and (C) were separately used in an amount equal to the total amount of these two binders in Example 33. The solids content of these paints and Brookfield viscosity thereof are also listed in Table VII.

TEST EXAMPLE

Cast-coated paper was prepared using the paint compositions obtained in the foregoing Examples and Comparative Examples in the same manner as in the aforementioned Test Example and casting speed, permeability, glossiness, surface strength and ink receptivity were likewise determined. The results thus obtained are summarized in Table VIII below.

As seen from the data listed in Tables VI and VIII, according to the paint compositions of the present invention in which each component fulfills the corresponding requirements, there are provided cast-coated papers having well-balanced qualities such as gloss, surface strength and permeability regardless of the paper being prepared by high speed production technique. This clearly indicates that the paint compositions according to the present invention, quite unlike the conventional compositions, are very useful for preparing the cast-coated paper.

TABLE VII

| Ingredients of | Example | | | | | | | | | | Comparative Example | | | |
|---|---|---|---|---|---|---|---|---|---|---|---|---|---|---|
| Coating Composition | 33 | 34 | 35 | 36 | 37 | 38 | 39 | 40 | 41 | 42 | 32 | 33 | 34 | 35 |
| Kaolin | 60 | 60 | 60 | 60 | 60 | 60 | 60 | 60 | 60 | 60 | 60 | 60 | 60 | 60 |
| Calcium carbonate | 40 | 40 | 40 | 40 | 40 | 40 | 40 | 40 | 40 | 40 | 40 | 40 | 40 | 40 |
| Casein (A) | 9 | 9 | 9 | 9 | 9 | 4 | 12 | 5 | 10 | 9 | 9 | 9 | 9 | 9 |
| Latex (B) | 12 | 12 | 12 | 16 | 7 | 12 | 12 | 10 | 15 | 12 | 12 | 12 | 19 | 5 |
| Latex (C) | 7 | 4 | 10 | 7 | 7 | 7 | 7 | 5 | 10 | 7 | 2 | 14 | 7 | 7 |
| Total amount of Binders | 28 | 25 | 31 | 32 | 23 | 23 | 31 | 20 | 35 | 28 | 23 | 35 | 35 | 21 |
| Sodium chloride | 0.3 | 0.3 | 0.3 | 0.3 | 0.3 | 0.1 | 0.4 | 0.2 | 0.3 | — | 0.3 | 0.3 | 0.3 | 0.3 |
| Zinc oxide | 3 | 3 | 3 | 3 | 3 | 1 | 4 | 2 | 3 | 3 | 3 | 3 | 3 | 3 |
| Calcium acetate | 0.7 | 0.4 | 1.0 | 0.7 | 0.7 | 0.7 | 0.7 | 0.5 | 1.0 | 0.7 | 0.2 | 1.4 | 0.7 | 0.7 |
| Solid content of Coating Composition (%) | 40 | 40 | 40 | 40 | 40 | 40 | 40 | 40 | 40 | 40 | 40 | 40 | 40 | 40 |
| Viscosity of Coating Composition (cps) | 45 | 52 | 35 | 40 | 50 | 30 | 92 | 35 | 70 | 37 | 50 | 34 | 55 | 65 |
| Particle size of Latex in Coating Composition (μm) | | | | | | | | | | | | | | |
| (B) | 0.15 ~ 1.05 | 0.15 ~ 1.05 | 0.15 ~ 1.05 | 0.1 ~ 1.05 | 0.15 ~ 1.05 | 0.3 ~ 1.2 | 0.1 ~ 0.9 | 0.3 ~ 1.5 | 0.15 ~ 1.05 | 0.15 ~ 1.5 | 0.15 ~ 1.05 | 0.15 ~ 1.05 | 0.15 ~ 1.05 | 0.15 ~ 1.05 |
| (C) | 0.75 ~ 1.05 | 0.75 ~ 1.05 | 0.75 ~ 1.05 | 0.75 ~ 1.05 | 0.75 ~ 1.05 | 0.9 ~ 1.2 | 0.5 ~ 0.9 | 0.9 ~ 1.5 | 0.75 ~ 1.05 | 1.05 ~ 1.5 | 0.75 ~ 1.05 | 0.75 ~ 1.05 | 0.75 ~ 1.05 | 0.75 ~ 1.05 |

| Ingredients of | Comparative Example | | | | | | |
|---|---|---|---|---|---|---|---|
| Coating Composition | 36 | 37 | 38 | 39 | 40 | 41 | 42 |
| Kaolin | 60 | 60 | 60 | 60 | 60 | 60 | 60 |
| Calcium carbonate | 40 | 40 | 40 | 40 | 40 | 40 | 40 |
| Casein (A) | 1 | 17 | 4 | 14 | 9 | 9 | 9 |
| Latex (B) | 12 | 12 | 8 | 17 | 12 | 19 | — |
| Latex (C) | 7 | 7 | 4 | 11 | 7 | — | 19 |
| Total amount of Binders | 20 | 36 | 16 | 42 | 28 | 28 | 28 |
| Sodium chloride | 0.1 | 0.6 | 0.1 | 0.5 | — | 0.3 | 0.3 |
| Zinc oxide | 1 | 6 | 1 | 5 | — | 3 | 3 |
| Calcium acetate | 0.7 | 0.7 | 0.8 | 1.7 | 0.7 | — | 1.9 |
| Solid content of Coating Composition (%) | 40 | 40 | 40 | 40 | 40 | 40 | 40 |
| Viscosity of Coating Composition (cps) | 28 | 1750 | 33 | 400 | 45 | 310 | 35 |
| Particle size of | | | | | | | |

TABLE VII-continued

| Latex in Coating Composition (μm) | | | | | | | |
|---|---|---|---|---|---|---|---|
| (B) | 0.15 | 0.15 | 0.35 | 0.08 | 0.15 | 0.15 | — |
| (C) | 1.2 ~ 1.5 | 0.3 ~ 0.45 | 1.35 ~ 2.1 | 0.3 ~ 0.6 | 1.35 ~ 1.8 | — | 0.75 ~ 1.05 |

TABLE VIII

| Coating Composition | Casting Speed (m/min) | Permeability Prior to Casting | Cast-coated Paper Surface Strength | Cast-coated Paper Gloss | Ink Receptivity |
|---|---|---|---|---|---|
| Example 33 | 75 | 500 | 10 | 93 | 1.75 |
| Example 34 | 75 | 480 | 10 | 93 | 1.78 |
| Example 35 | 75 | 560 | 10 | 93 | 1.77 |
| Example 36 | 75 | 700 | 10 | 93 | 1.78 |
| Example 37 | 75 | 440 | 9.5 | 92 | 1.78 |
| Example 38 | 75 | 400 | 9 | 93 | 1.77 |
| Example 39 | 75 | 650 | 10 | 92 | 1.78 |
| Example 40 | 75 | 400 | 9 | 90 | 1.78 |
| Example 41 | 70 | 780 | 10 | 93 | 1.76 |
| Example 42 | 70 | 570 | 10 | 91 | 1.78 |
| Comp. Ex. 32 | 50 | 510 | 9 | 80 | 1.78 |
| Comp. Ex. 33 | 50 | 950 | 10 | 92 | 1.75 |
| Comp. Ex. 34 | 45 | 1200 | 10 | 91 | 1.77 |
| Comp. Ex. 35 | 45 | 400 | 6 | 90 | 1.76 |
| Comp. Ex. 36 | 45 | 380 | 3 | 87 | 1.78 |
| Comp. Ex. 37 | 40 | 2300 | 10 | 90 | 1.75 |
| Comp. Ex. 38 | 50 | 350 | 4 | 86 | 1.78 |
| Comp. Ex. 39 | 40 | 3000 | 10 | 90 | 1.74 |
| Comp. Ex. 40 | 40 | 4200 | 10 | 88 | 1.75 |
| Comp. Ex. 41 | 30 | 5600 | 10 | 82 | 1.78 |
| Comp. Ex. 42 | 55 | 300 | 5 | 91 | 1.73 |

EXAMPLE 43

(Preparation of Latex (A) 1)

Deionized water (120 parts), sodium dodecylbenzenesulfonate (0.2 parts), potassium persulfate (0.8 parts), t-dodecyl mercaptan (hereunder referred to as "TDM"; 0.6 parts), and monomer components, i.e., 40 parts of butadiene, 45 parts of styrene, 8 parts of methyl methacrylate and, as functional monomers, 2 parts of acrylic acid, 2 parts of acrylamide and 3 parts of hydroxyethyl methacrylate (100 parts of monomers in all) were charged into an autoclave purged with nitrogen gas, followed by polymerizing the monomers at 70° C, stopping the polymerization after 15 hours when degree of polymerization exceeded 98%, cooling the reaction mixture and adjusting pH to 7 with sodium hydroxide to obtain a latex (A). The gel content of the latex was 75% (the latex is hereunder referred to as "latex A-11").

(Preparations of Latex (A) 2 to 6)

Latexes A-12 to A-16 having different gel contents were prepared according to the same procedures and operations as in "Preparation of Latex (A) 1" except for changing the amount of TDM used. The amount of TDM and the gel contents of the resulting latexes (A) are shown in Table IX.

(Preparation of Comparative Latex)

A comparative latex having a gel content of 40% was prepared according to the same procedures and operations as in "Preparation of Latex (A) 1" except for changing the amount of TDM used (the resultant latex will hereunder referred to as "comparative latex a-1").

TABLE IX

| Latex No. | Amount of TDM (parts) | Gel Content (%) |
|---|---|---|
| A-11 | 0.6 | 75 |
| A-12 | 1.0 | 50 |
| A-13 | 0.8 | 60 |
| A-14 | 0.4 | 85 |
| A-15 | 0.2 | 95 |
| a-1 | 1.2 | 40 |

(Preparation of Acrylic Emulsion (B) 1)

Deionized water (120 parts), sodium dodecylbenzenesulfonate (0.1 parts), ammonium persulfate (0.8 parts), divinyl benzene (0.5 parts), and monomer components, i.e., 40 parts of butyl acrylate, 40 parts of styrene, 17 parts of acrylonitrile and 3 parts of methacrylic acid (100 parts of monomers in all) were charged into a three-necked glass reactor purged with nitrogen gas, followed by polymerizing the monomers at 70° C, stopping the polymerization after 8 hours when the degree of polymerization exceeded 97%, cooling the reaction mixture and adjusting pH to 7 with an aqueous ammonia solution to obtain an acryl emulsion (B) having a gel content of 75% (the latex will hereunder referred to as "acryl emulsion B-1").

(Preparations of Acrylic Emulsion (B) 2 to 5)

Acryl emulsions B-2 to B-5 having different gel contents were prepared according to the same procedures and operations as in "Preparation of Acryl Emulsion (B) 1" except for changing the amount of divinyl benzene used. The amount of divinyl benzene and the gel contents of the resulting acrylic emulsions (B) are shown in Table X.

(Preparation of Comparative Acrylic Emulsion)

A comparative acrylic emulsion having a gel content of 40% was prepared according to the same procedures and operations as in "Preparation of Acrylic Emulsion (B) 1" except for using 0.2 parts of lauryl mercaptan in place of divinyl benzene (the resultant acryl emulsion will hereunder be referred to as "comparative acryl emulsion b-1").

TABLE X

| Acrylic Emulsion No. | Amount of divinyl benzene (parts) | Amount of lauryl mercaptan (parts) | Gel content (%) |
|---|---|---|---|
| B-1 | 0.5 | — | 75 |
| B-2 | 0.1 | — | 50 |
| B-3 | 0.3 | — | 60 |
| B-4 | 1.0 | — | 85 |
| B-5 | 1.5 | — | 95 |
| b-1 | — | 0.2 | 40 |

(Preparation of Coating Composition)

53.3 Parts of an aqueous casein solution (corresponding to 8 parts expressed in the amount of solid) prepared by heating a mixture of 28% aqueous ammonia (0.8 parts), 8 parts of milk casein and 44.5 parts of water to dissolve these ingredients and 100 parts of water were charged into a Cauress mixer, followed by adding 40 parts of calcium carbonate (TP-222HS; available from OKUTAMA KOGYO CO., LTD.) and 60 parts of kaolin (UW-90; available from EMC) with stirring to admix and disperse the components, adding 3.5 parts (corresponding to 0.7 parts expressed in the amount of solids content) of 20% aqueous solution of calcium acetate and then adding 12 parts (solids content) of the latex A-11 and 7 parts (solid content) of the acryl emulsion B-1 previously prepared. Finally, the solids content of the paint was controlled to 40% to obtain a paint composition for cast-coated paper according to the present invention.

EXAMPLES 44 TO 55

Coating compositions were prepared according to the same procedures and operations as in Example 43 except that each combination of one latex selected from the latexes A-11 to A-15 and acrylic emulsion selected from the acrylic emulsions B-1 to B-5 was substituted for the combination of the latex A-11 and the acryl emulsion B-1 used in Example 43.

COMPARATIVE EXAMPLES 43 TO 45

Comparative coating compositions were prepared according to the same procedures and operations as in Example 43 except that the latexes and/or the acrylic emulsions with gel contents outside the range of this invention were substituted for either or both of the latex A-11 and the acryl emulsion B-1 used in Example 43. Each combination of these synthetic binders in the comparative paint compositions is summarized in Table XI.

COMPARATIVE EXAMPLES 46 AND 47

In these Comparative Examples, there are illustrated experiments in which the latex A-11 and the acryl emulsion B-1 are separately employed in the paint compositions in order to make the effectiveness of the simultaneous use of these two synthetic binders clearer. In other words, comparative compositions were prepared according to the same procedures and conditions as in Example 43 except that, as shown in Table XI, the latex A-11 and the acryl emulsion B-1 were separately used in an amount equal to the total amount of these two binders in Example 43.

TEST EXAMPLE

Cast-coated paper was prepared using the paint compositions obtained in the foregoing Examples and Comparative Examples in the same manner as in the aforementioned Test Example and casting speed, permeability, gloss, surface strength and ink receptivity thereof were likewise determined. The results thus obtained are summarized in Table XI below.

TABLE XI

| Coating Composition | Combination of Synthetic Binders | | Casting Speed | Permability Prior | Cast-Coated Paper | |
|---|---|---|---|---|---|---|
| | Latex | Acrylic Emulsion | (m/min.) | to Casting (sec.) | Surface Strength | Gloss (%) |
| Example 43 | A-11 | B-1 | 70 | 1200 | 10 | 91 |
| Example 44 | A-11 | B-2 | 60 | 1450 | 10 | 90 |
| Example 45 | A-11 | B-3 | 65 | 1350 | 10 | 91 |
| Example 46 | A-11 | B-4 | 70 | 1100 | 9.5 | 92 |
| Example 47 | A-11 | B-5 | 70 | 1050 | 9 | 92 |
| Example 48 | A-12 | B-1 | 60 | 1150 | 9 | 92 |
| Example 49 | A-13 | B-1 | 65 | 1250 | 9.5 | 91 |
| Example 50 | A-14 | B-1 | 70 | 1200 | 10 | 90 |
| Example 51 | A-15 | B-1 | 70 | 1150 | 10 | 90 |
| Example 52 | A-12 | B-2 | 60 | 1300 | 9 | 92 |
| Example 53 | A-13 | B-3 | 65 | 1250 | 9.5 | 91 |
| Example 54 | A-14 | B-4 | 70 | 1100 | 10 | 90 |
| Example 55 | A-15 | B-5 | 70 | 1000 | 10 | 90 |
| Comp. Ex. 43 | A-11 | b-1 | 40 | 2200 | 8 | 85 |
| Comp. Ex. 44 | a-1 | B-1 | 45 | 2400 | 7 | 86 |
| Comp. Ex. 45 | a-1 | b-1 | 30 | 4000 | 4 | 80 |
| Comp. Ex. 46 | A-11 | — | 35 | 4600 | 10 | 83 |
| Comp. Ex. 47 | — | B-1 | 50 | 1000 | 5 | 91 |

What is claimed is:

1. A coating composition for a cast-coated paper which comprises mainly a pigment and an adhesive, characterized in that the adhesive comprises per 100 parts by weight of the pigment, (A) 2 to 15 parts by weight of casein; (B) 6 to 18 parts by weight, expressed in solids content, of a rubber latex having an average particle size ranging from 0.1 to 0.3 microns; (C) 3 to 12 parts by weight, expressed in solids content, of an acrylic emulsion or a secondary particle-forming rubber latex having an average particle size ranging from 0.1 to 0.3 microns; and (D) at least one inorganic compound selected from the group consisting of NaCl, $Na_2SO_4$, ZnO and MgO and at least one organic acid salt selected from the group consisting of formates and acetates of calcium, zinc and magnesium, the total solids content of the components (A), (B) and (C) being in the range of 18 to 40 parts by weight.

2. The coating composition according to claim 1 wherein the latexes as the components (B) and (C) are a rubber emulsion of polymer having repeating units derived from diene type monomers as essential units.

3. The coating composition according to claim 1 wherein the acrylic emulsion as the component (C) is an emulsion of a polymer having repeating units derived from at least one monomer selected from the group consisting of aromatic alkenyl compounds and non-aromatic mono-olefinic unsaturated compounds as principal repeating units.

4. The coating composition according to claim 1 wherein the amount of the component (D) composed of the inorganic and organic compounds to be added to the composition is determined so that the component (C) used as the synthetic binder having a particle size of 0.1 to 0.3 microns is selectively aggregated to form secondary particles and to increase the particle size of the resulting aggregates to 0.5 to 1.5 microns.

5. The coating composition according to claim 4 wherein the amount of the inorganic compound ranges from 0.1 to 7 parts by weight and the amount of the organic acid salt ranges from 0.1 to 3 parts by weight, per 100 parts by weight of the pigment.

* * * * *